US005144703A

United States Patent [19]

Maire

[11] Patent Number: 5,144,703

[45] Date of Patent: Sep. 8, 1992

[54] BATHTUB LINER

[76] Inventor: Laura M. Maire, 2401 27th St., Dickinson, Tex. 77539

[21] Appl. No.: 663,683

[22] Filed: Mar. 4, 1991

[51] Int. Cl.[5] ..... A47K 3/02

[52] U.S. Cl. ..... 4/580; 4/583

[58] Field of Search ..... 4/580, 581, 582, 583, 4/DIG. 18, 585, 588, 657, 659

[56] References Cited

U.S. PATENT DOCUMENTS

| | | | |
|---|---|---|---|
| 1,702,635 | 2/1929 | Hasalone | 4/583 |
| 1,759,348 | 5/1930 | Fishman | 4/583 X |
| 2,264,672 | 12/1941 | Levine | 4/580 |
| 2,495,602 | 1/1950 | Rinaldi | 4/583 |
| 2,817,489 | 12/1957 | Hesmer | 251/305 X |
| 3,020,562 | 2/1962 | Reynolds | 4/583 |
| 3,253,293 | 5/1966 | George et al. | 4/581 X |
| 3,892,000 | 7/1975 | Morse | 4/580 |
| 4,630,323 | 12/1986 | Sage et al. | 4/580 |
| 4,744,112 | 5/1988 | Keesling, Jr. | 4/580 |
| 4,928,336 | 5/1990 | Petillo, Sr. | 5/441 |

FOREIGN PATENT DOCUMENTS

| | | | |
|---|---|---|---|
| 809206 | 2/1959 | Canada | 5/456 |
| 616246 | 7/1935 | Fed. Rep. of Germany | 5/456 |
| 2853071 | 6/1980 | Fed. Rep. of Germany | 4/583 |
| 164789 | 1/1934 | Switzerland | 5/456 |

*Primary Examiner*—Henry J. Recla
*Assistant Examiner*—Robert M. Fetsuga
*Attorney, Agent, or Firm*—Leon Gilden

[57] ABSTRACT

An apparatus for insertion within a bathtub defined by spaced parallel side walls, a floor coextensive with the side walls, and a rear wall mounting a cushion at an upper terminal end thereof directed orthogonally between the side walls. The side walls are pneumatically or fluidly filled within chambers formed in the side walls, wherein the floor includes a chamber for filling overlying a lower chamber filled with a granular material to effect stable positioning of the organization in use. Suction cup members are mounted coextensively along the floor, side walls, and cushion for securement to an interior surface of an associated bathtub.

1 Claim, 4 Drawing Sheets

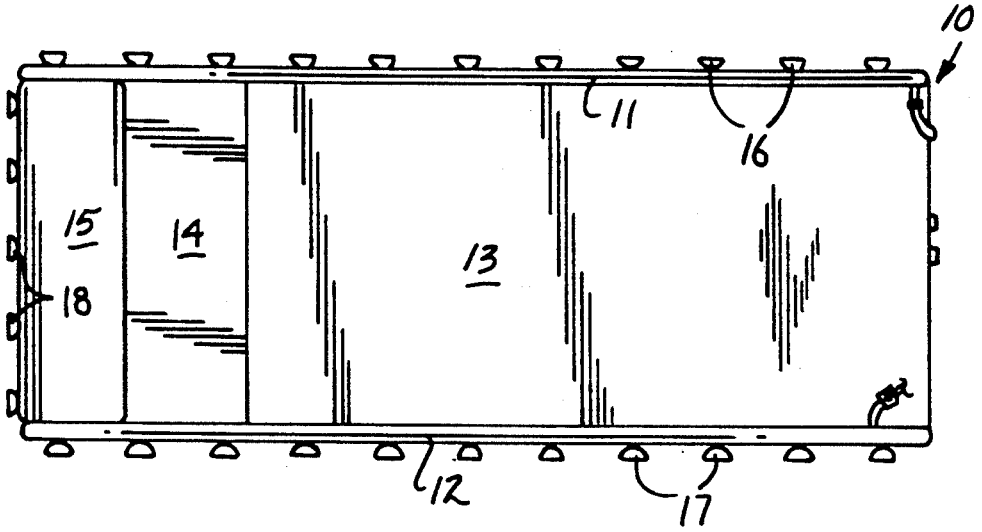
FIG 1
FIG 2
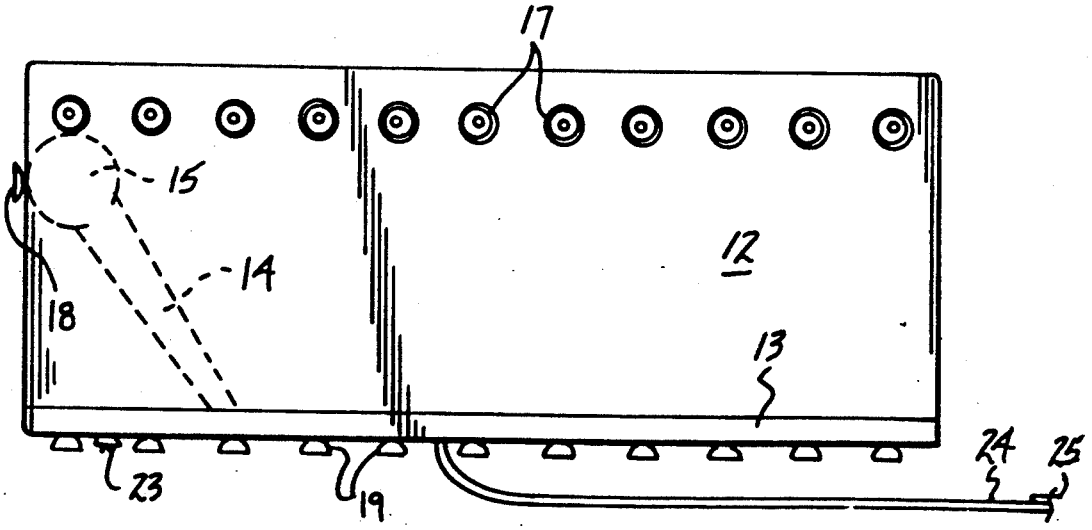

15
31
30
14
31
30
30
31
13
11
17
32
33
36
26
35
34
27
28
12
27
24
29
25

24
11
12
23

11
18
12

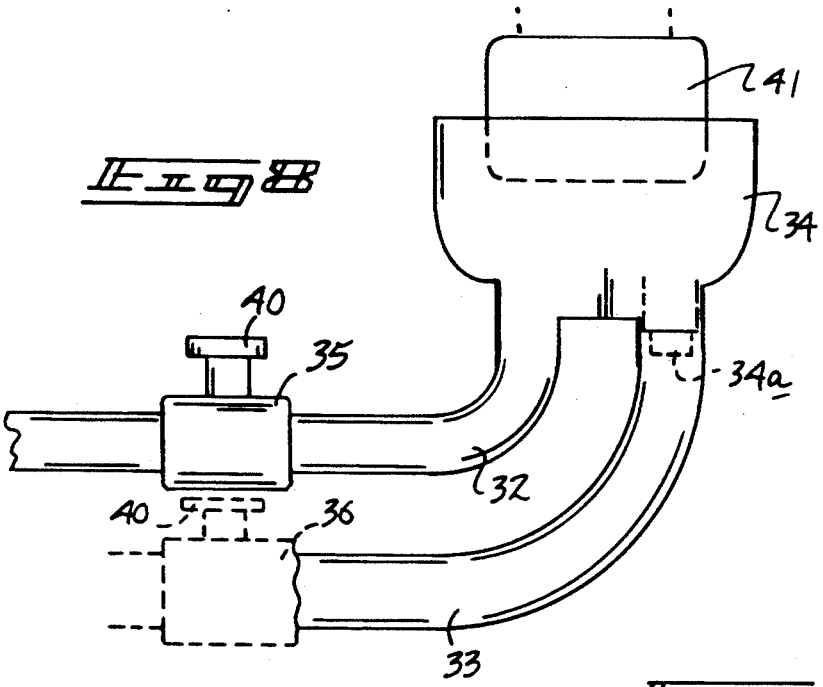
Fig 8
Fig 9
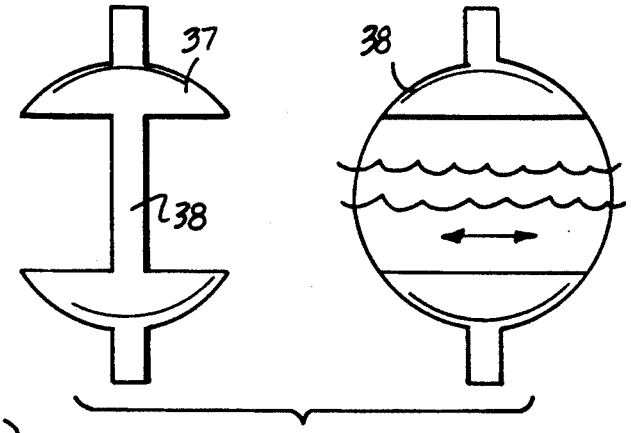
Fig 10
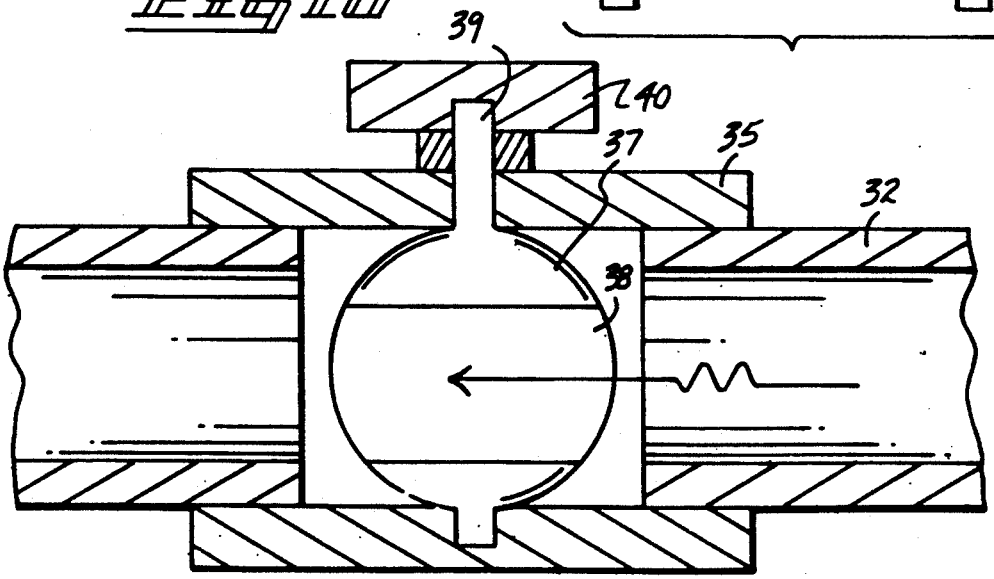

BATHTUB LINER

BACKGROUND OF THE INVENTION

1. Field of the Invention

The field of the invention relates to bathtub apparatus, and more particularly pertains to a new and improved bathtub liner wherein the same is arranged for positioning within an associated bathtub for enhanced comfort of an individual.

2. Description of the Prior Art

Various bathtub insert organizations are utilized in the prior art to provide padded liner structure. Such apparatus may be found in U.S. Pat. No. 4,630,323 to Sage, et al. wherein a liner includes a floor with side walls and a rear wall for mounting within a bathtub structure.

U.S. Pat. No. 4,069,523 to Ridgeway sets forth a unitary liner structure formed with a cushioned layer throughout.

U.S. Pat. No. 3,892,000 to Morse sets forth a padded liner structure mounted within a bathtub, wherein the liner structure utilizes various chambers.

As such, it may be appreciated that there continues to be a need for a new and improved bathtub liner as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of bathtub liners now present in the prior art, the present invention provides a bathtub liner wherein the same utilizes a foldable liner structure arranged for mounting within an associated bathtub. As such, the general purpose of the present invention, which will be described subsequently in greater detail, is to provide a new and improved bathtub liner which has all the advantages of the prior art bathtub liners and none of the disadvantages.

To attain this, the present invention provides an apparatus for insertion within a bathtub defined by spaced parallel side walls, a floor coextensive with the side walls, and a rear wall mounting a cushion at an upper terminal end thereof directed orthogonally between the side walls. The side walls are pneumatically or fluidly filled within chambers formed in the side walls, wherein the floor includes a chamber for filling overlying a lower chamber filled with a granular material to effect stable positioning of the organization in use. Suction cup members are mounted coextensively along the floor, side walls, and cushion for securement to an interior surface of an associated bathtub.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bathtub liner which has all the advantages of the prior art bathtub liners and none of the disadvantages.

It is another object of the present invention to provide a new and improved bathtub liner which may be easily and efficiently manufactured and marketed.

It is a further object of the present invention to provide a new and improved bathtub liner which is of a durable and reliable construction.

An even further object of the present invention is to provide a new and improved bathtub liner which is susceptible of a low cost of manufacture with regard to both materials and labor, and which accordingly is then susceptible of low prices of sale to the consuming public, thereby making such bathtub liners economically available to the buying public.

Still yet another object of the present invention is to provide a new and improved bathtub liner which provides in the apparatuses and methods of the prior art some of the advantages thereof, while simultaneously overcoming some of the disadvantages normally associated therewith.

Still another object of the present invention is to provide a new and improved bathtub liner wherein the same is arranged for convenience of mounting within a bathtub utilizing separable chambers for fluid and pneumatic filling of the apparatus and valving structure to provide predetermined pressurizing of the walls of the organization.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an orthographic top view of the instant invention.

FIG. 2 is an orthographic side view of the instant invention.

FIG. 8 is an enlarged orthographic view of the side wall fluid fill coupling utilized by the instant invention.

FIG. 9 is an orthographic view of the valve utilized by the valve structure of the instant invention, as set forth in FIG. 8.

FIG. 10 is an orthographic cross-sectional view of the valve structure utilized by the instant invention.

DESCRIPTION OF THE PREFERRED EMBODIMENT

Figure 3:
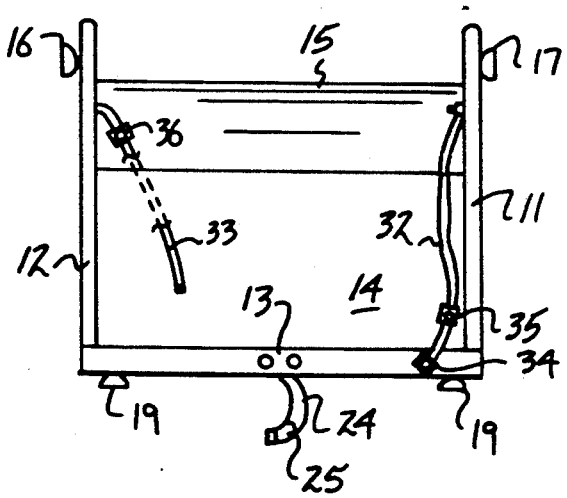
FIG. 3 is an orthographic frontal view, taken in elevation, of the instant invention.
Figure 4:
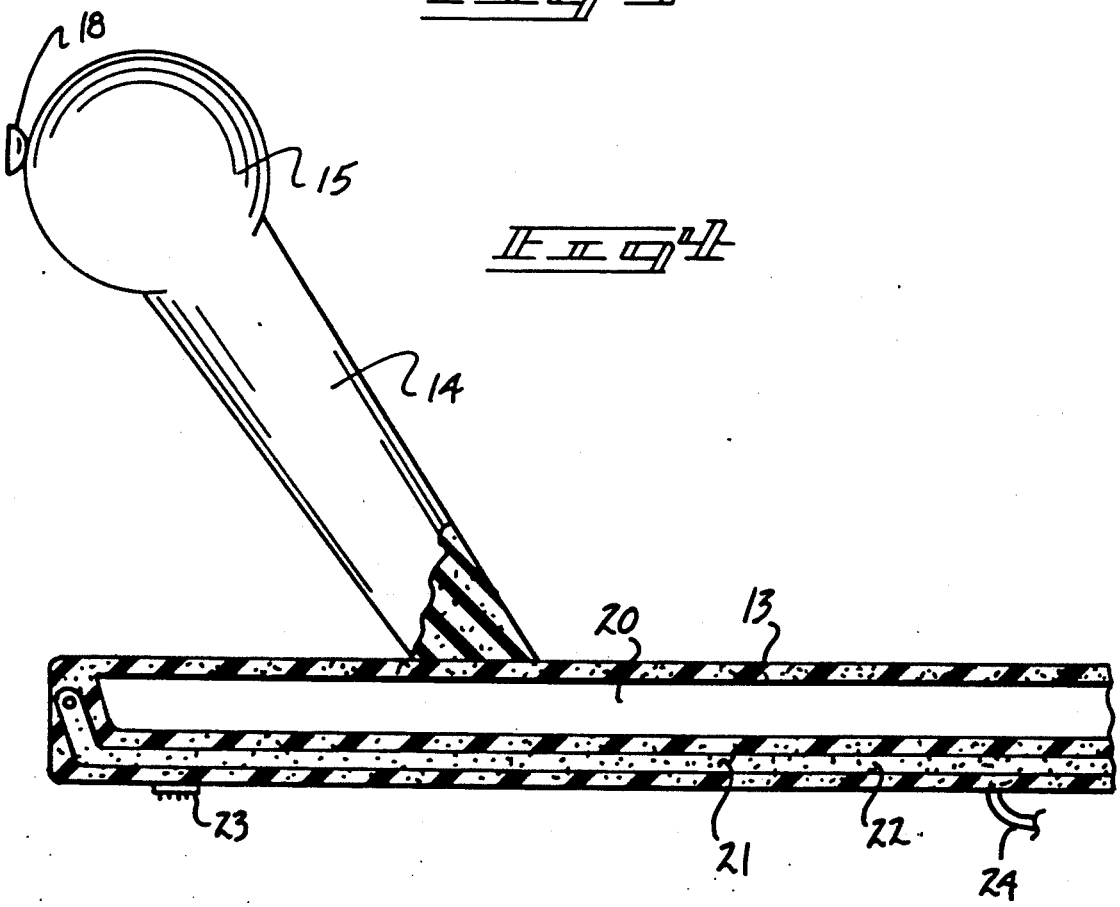
FIG. 4 is an orthographic cross-sectional illustration of the floor and rear wall utilized by the instant invention.
Figure 5:
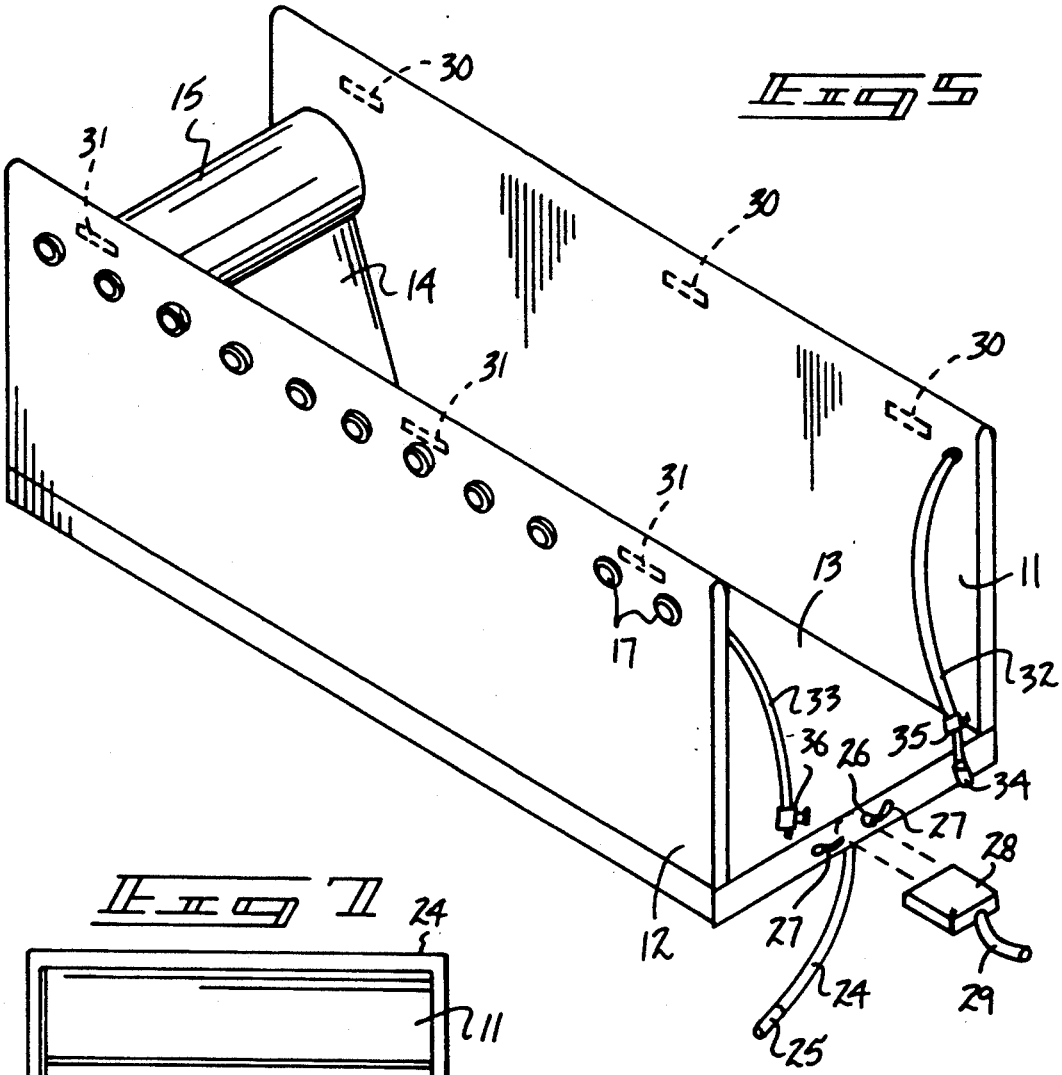
FIG. 5 is an isometric illustration of the instant invention.

With reference now to the drawings, and in particular to FIGS. 1 to 10 thereof, a new and improved bathtub liner embodying the principles and concepts of the present invention and generally designated by the reference numeral 10 will be described.

More specifically, the bathtub liner apparatus of the invention essentially comprises a flexible left wall 11 spaced from and parallel to a flexible right wall 12, each flexible wall mounted at its lower terminal end to a floor member 13 that is directed coextensively with the left and right walls, with the left and right walls mounted to opposed side edge portions of the floor member. A rear wall 14 is mounted adjacent to a rear terminal edge of a floor member 13, with the rear wall 14 including a cushion 15 of a generally cylindrical configuration mounted coextensively to an upper terminal end of the rear wall 14. The left wall 11, the right wall 12, and the floor member 13 each include chambers coextensive with the wall and floor members to permit selective fluid or pneumatic filling thereof, to be described in more detail below. The left wall 11 includes a series of equally spaced left wall suction cups 16 mounted coextensively adjacent an upper terminal end of the left wall 11, with a series of equally spaced right suction cups 17 mounted coextensively to an upper terminal edge of the right wall 12. A series of cushion suction cups 18 are mounted to a rear surface of the cushion 15. The suction cups permit securement of the organization to an interior surface of a bathtub (not shown). Further in the same manner, at least a plurality of rows of floor suction cups 19 are mounted coextensively adjacent respective right and left edge portions of the floor adjacent respective left and right walls 11 and 12.

The floor member 13 includes an upper chamber 20 (see FIG. 4) that permits selective fluid or pneumatic filling thereof through a plurality of floor fill nozzles 26 that are provided with nozzle caps 27 that are arranged to effect closure of the nozzle 26 subsequent to a filling procedure. A floor connector block 28 is provided for securement to the fill nozzles 26, wherein a floor connector block fill tube 29 directs a source of pneumatic or fluid (not shown) to be directed through the fill tube 29 into the upper chamber 20. A lower chamber 21 is coextensive with the floor, as is the upper chamber 20, wherein the lower chamber 21 is filled with a granular fill material 22 such as sand to provide stability to the organization when mounted to a floor of an associated bathtub.

A plurality of respective first and second magnetic strips 30 and 31 are mounted interiorly of the respective left and right walls 11 and 12 adjacent the upper terminal edges thereof to provide adherence of shower curtain magnets (not shown) that are frequently utilized in bathtub environments to provide a plurality of convenient positions for mounting of such shower curtain structure thereto, wherein the magnets are positioned in both left and right walls to accommodate positioning of the liner within a plurality of bathtubs whose shower curtains may be oriented on various sides thereof.

The right wall 12 includes a right wall fill tube, while the left wall 11 includes a left wall fill tube to direct either selective filling of fluid or pneumatic pressure from an associated fluid or pneumatic source 41 (see FIG. 8). To this end, each fill tube 32 and 33 includes a respective first and second valve 35 and 36 to permit selective filling and pressurizing of each fill tube and accordingly each respective left and right wall to a predetermined pressure that may be varied from each wall and accordingly each of the tubes 32 and 33 is provided with its individual valve structure set forth as a respective first and second valve 35 and 36. A connector block connector plug 34*a* is fixedly mounted in communication with the wall fill tube connector block 34 permitting securement of the left wall fill tube 33 thereto, in a manner as illustrated in FIG. 8.

Each respective valve 35 and 36 includes a rotatable valve member 37 positioned therewithin. The valve member includes a valve wall 38 diametrically directed through the valve member 37, whereupon rotation of the valve member 37 by an adjustment disk 40 that projects exteriorly of each valve housing, the valve member 37 is rotated about its respective axle 39 to permit selective confrontation of the wall 38 with fluid flow or permit repositioning of the wall 38 ninety degrees relative to its first position, as illustrated in FIG. 9, to permit selective flow of fluid or gaseous pressure directed therethrough.

Figure 7:
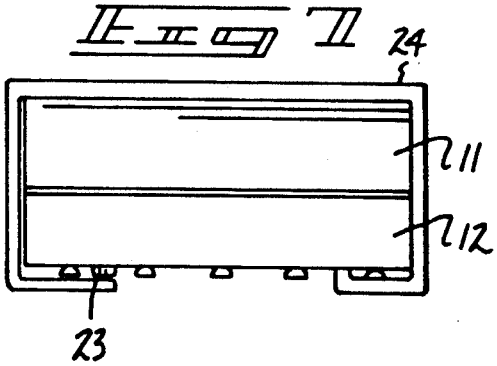
FIG. 7 is an orthographic view of the invention in a folded configuration.
Figure 6:
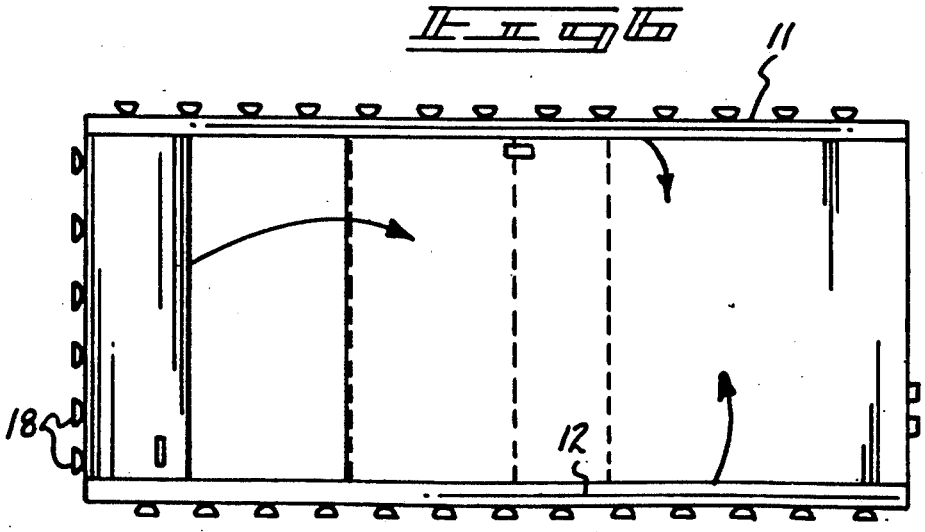
FIG. 6 is an orthographic top view of the invention in a partially folded configuration.

The organization may be finely interfolded into a compact organization, as illustrated in FIG. 7, wherein the side walls 11 and 12 are folded downwardly subsequent to folding of the rear wall 14 onto the floor member 13. A connector strap 24 is mounted somewhat medially of the floor member 13 and is secured to a first hook and loop fastener patch 23 mounted to the floor member adjacent the rear edge thereof, wherein the connector strap 24 includes a second hook and loop fastener patch 25 mounted on a free terminal end thereof to effect surrounding securement of the organization in a compact unit, as illustrated in FIG. 7, subsequent to its folding.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bathtub liner comprising, in combination, an elongate, generally rectangular floor member, the floor member including a left wall mounted hingedly and coextensively to a left edge of the floor member, and a right wall mounted hingedly and coextensively to a right edge of the floor member, and a rear wall orthogonally oriented relative to the left wall and right wall hingedly mounted at its lower terminal edge to a top surface of the floor member spaced from a rear terminal edge of the floor member, and the rear wall including a cushion member coextensively mounted to an upper terminal edge of the rear wall, and the left wall and the right wall each define a chamber therewithin, wherein each chamber is directed coextensively of the left and right wall, and the left wall includes a left wall fill tube and the right wall includes a right wall fill tube each communicating with the respective chambers and the left wall fill tube includes a first valve therein and the right wall fill tube includes a second valve therein, and the left wall fill tube includes a wall fill tube connector block connected to a terminal end thereof, the wall fill tube connector block having a connector plug receiving a free terminal end of the right wall fill tube thereto, and the first and second valves each include a housing, and each housing includes a rotatable valve member positioned therewithin, each valve member including an axle, wherein the axle projects through the housing, and each axle mounts an adjustment disk orthogonally thereto to permit rotation of the valve member, and the valve member includes a planar wall diametrically directed through the valve member to permit selective blockage and free flow of pneumatic gas or fluid through each valve, and the floor member includes an upper chamber arranged coextensively with the floor, wherein the upper chamber includes a plurality of floor fill nozzles in fluid communication with the upper chamber, wherein each of the floor fill nozzles are arranged for reception of fluid filling of the upper chamber, and the floor member further including a lower chamber coextensive with the floor member and underlying the upper chamber, wherein the lower chamber is filled with a granular material effecting stability of the apparatus when positioned within a bathtub, and the left wall includes a series of left wall suction cups mounted thereto, the right wall includes a series of right wall suction cups mounted thereto, and the floor member includes a series of floor member suction cups mounted thereto for securement of the left wall, right wall, and floor member to interior surfaces of the associated bathtub, and the cushion includes a series of cushion suction cups mounted to the cushion on a rear surface thereof for securement of the cushion to a surface of the associated bathtub, and the left wall includes a plurality of first magnetic strips mounted within the left wall adjacent an upper terminal end thereof, and the right wall includes a plurality of second magnetic strips mounted within the right wall adjacent an upper terminal end thereof, and the floor member includes a connector strap mounted medially to a bottom surface of the floor member, and a first hook and loop fastener patch mounted to the bottom surface of the floor member, adjacent the rear terminal edge thereof, and the connector strap includes a second hook and loop fastener patch at a free terminal end of the connector strap for securement to the first hook and loop fastener patch when the rear wall, the left wall, and the right wall are in an interfolded relationship relative to the floor member.

* * * * *